US009725817B2

(12) United States Patent
Lackner et al.

(10) Patent No.: US 9,725,817 B2
(45) Date of Patent: Aug. 8, 2017

(54) SYSTEM AND METHOD FOR ELECTROPOLISHING OR ELECTROPLATING CONVEYOR BELTS

(75) Inventors: Joseph M. Lackner, Medina, MN (US); Jonathan R. Lasecki, Strasburg, VA (US); Paul Steinhoff, Stephens City, VA (US)

(73) Assignee: ASHWORTH BROS., INC., Fall River, MA (US)

( * ) Notice: Subject to any disclaimer, the term of this patent is extended or adjusted under 35 U.S.C. 154(b) by 555 days.

(21) Appl. No.: 13/465,180

(22) Filed: May 7, 2012

(65) Prior Publication Data

US 2013/0168256 A1 Jul. 4, 2013

Related U.S. Application Data

(60) Provisional application No. 61/581,929, filed on Dec. 30, 2011.

(51) Int. Cl.
*C25D 7/06* (2006.01)
*C25F 1/06* (2006.01)
(Continued)

(52) U.S. Cl.
CPC ..... *C25D 7/0614* (2013.01); *C25D 7/0628* (2013.01); *C25D 7/0657* (2013.01);
(Continued)

(58) Field of Classification Search
CPC ..... B41C 1/1016; B41C 2201/02; B42C 2210/06; B41N 3/034; B41N 3/03;
(Continued)

(56) References Cited

U.S. PATENT DOCUMENTS 3,391,073 A 7/1968 Rusch et al.
3,536,272 A * 10/1970 Ueyama ..... B65H 54/40 242/413.9
(Continued)

FOREIGN PATENT DOCUMENTS

CH 470486 5/1969
CN 1237942 A 12/1999
(Continued)

OTHER PUBLICATIONS

Clapham, Christopher, and James Nicholson. "tension." The Concise Oxford Dictionary of Mathematics. : Oxford University Press, 2009. Oxford Reference. 2009. <http://www.oxfordreference.com/view/10.1093/acref/9780199235940.001.0001/acref-9780199235940-e-2802>.*
(Continued)

*Primary Examiner* — Nicholas A Smith
(74) *Attorney, Agent, or Firm* — Nixon Peabody LLP

(57) ABSTRACT

An electropolishing or electroplating system and method for metal conveyor belts is described. In some embodiments, the system has a metal conveyor belt held in constant tension; a tank for holding an electrolytic fluid, the tank having an interior space suitable to contain the fluid, a metal plate and the metal conveyor belt; and an electrical current supply. In an electropolishing application, the current passes from the metal conveyor belt, through the fluid and into the metal plate. In an electroplating application, the current passes from the metal plate, through the fluid and into the metal conveyor belt.

13 Claims, 8 Drawing Sheets

(51) Int. Cl.

| | |
|---|---|
| ***C25F 1/14*** | (2006.01) |
| ***C25F 3/14*** | (2006.01) |
| ***C25F 3/24*** | (2006.01) |
| ***C25F 7/00*** | (2006.01) |
| ***C25F 3/16*** | (2006.01) |

(52) U.S. Cl.
CPC ..... *C25F 1/06* (2013.01); *C25F 1/14* (2013.01); *C25F 3/14* (2013.01); *C25F 3/16* (2013.01); *C25F 3/24* (2013.01); *C25F 7/00* (2013.01)

(58) Field of Classification Search
CPC . C25D 7/0657; C25F 1/06; C25F 1/14; C25F 3/14; C25F 3/24
USPC ..... 205/138
See application file for complete search history.

(56) References Cited

U.S. PATENT DOCUMENTS

| | | | | |
|---|---|---|---|---|
| 3,834,999 | A | 9/1974 | Hradcovsky et al. | |
| 4,124,454 | A | 11/1978 | Shang | |
| 4,183,799 | A | 1/1980 | Sellitto et al. | |
| 4,390,407 | A | 6/1983 | Mori et al. | |
| 4,532,014 | A | 7/1985 | Polan et al. | |
| 4,652,346 | A | 3/1987 | Polan | |
| 4,793,564 | A * | 12/1988 | Hank | B65H 19/14 226/118.2 |
| 4,877,494 | A | 10/1989 | Kanamaru et al. | |
| 4,895,633 | A | 1/1990 | Seto et al. | |
| 4,900,406 | A | 2/1990 | Janssen et al. | |
| 5,053,598 | A * | 10/1991 | Sakai | B23H 7/10 219/69.12 |
| 5,171,419 | A * | 12/1992 | Wheeler et al. | 205/176 |
| 5,491,036 | A | 2/1996 | Carey, II et al. | |
| 6,231,728 | B1 * | 5/2001 | Metzger | 204/212 |
| 7,407,051 | B1 | 8/2008 | Farris et al. | |
| 2001/0040097 | A1 * | 11/2001 | Arao | B21C 47/003 205/82 |
| 2004/0026256 | A1 * | 2/2004 | Lindgren | C25D 17/00 205/137 |
| 2005/0061661 | A1 * | 3/2005 | Muller-Hipper et al. | 204/203 |

FOREIGN PATENT DOCUMENTS

| | | | |
|---|---|---|---|
| DE | 1295473 | B | 5/1969 |
| GB | 480352 | | 2/1938 |
| GB | 528347 | A | 10/1940 |
| GB | 1482958 | A | 8/1977 |
| JP | 53-095131 | | 8/1978 |
| JP | 1986-111969 | | 7/1986 |
| JP | 1996-239782 | | 9/1996 |
| JP | 11-200099 | | 7/1999 |
| JP | 1999-235077 | | 8/1999 |
| JP | 2002-060994 | | 2/2002 |
| WO | 9822372 | A1 | 5/1998 |
| WO | WO 2006/137555 | A1 | 12/2006 |

OTHER PUBLICATIONS

International Search Report—PCT/2012/072001, mailed Mar. 19, 2013.
Written Opinion of the International Searching Authority—PCT/2012/072001 (PCT Rule 43*bis*. 1), mailed Mar. 19, 2013.
Japanese Office Action for corresponding Japanese Application No. 2014-550497, dated Sep. 1, 2015, with English translation, 5 pages.
Second Office Action of Chinese Application No. 201280065411.8 dated Aug. 3, 2016, with English translation (4 pages).
European Office Action from corresponding Application No. 12 821 003.6-1360 dated Jul. 6, 2016, 4 pages.
Chinese Office Action from corresponding Application No. 201280065411.8 dated Nov. 8, 2016 with English Translation, 13 pages.
EPO Communication from Application No. 12 821 003.6-1360 dated Feb. 16, 2017, 4 pages.
Chinese Office Action from Chinese Patent Application No. 201280065411.8 with English translation, dated Apr. 28, 2017, 9 pages.

* cited by examiner

SYSTEM AND METHOD FOR ELECTROPOLISHING OR ELECTROPLATING CONVEYOR BELTS

BACKGROUND

Field

Embodiments of the claimed invention relate to electropolishing and electroplating, and in particular, systems and methods for electropolishing or electroplating continuous assemblies of interconnected components, such as conveyor belts.

Description of Related Art

Conveyor belt systems are used in various industrial fields for material handling and processing purposes. For instance, conveyor systems are used within food processing systems in which food items are placed on the support surface of a conveyor belt and processed, while being conveyed from one location to another. Various types of conveyor belts exist, including modular conveyor belts, which are especially popular in food processing systems. Moreover, conveyor systems are often used in a helical accumulator such as that disclose in U.S. Pat. No. 5,070,999 to Layne et al. which allows storage of a large number of items in the conveyor system.

In the food processing industry, it is of the utmost importance that conveyors belts are sanitary. To accomplish this, conveyor belts are conventionally wiped down, washed, and/or steamed on a regular basis. However, conveyor belts are often very long, extending hundreds or even thousands of feet. In these cases, the belts can be difficult to clean and may become less durable over time due to the thorough process needed to maintain their sanitation.

Electropolishing and electroplating has been previously used in a number of applications. U.S. Pat. No. 4,895,633 to Seto et al. discloses a conventional molten salt electroplating apparatus for forming plating on steel strips, sheets, and wires. A steel strip is continuously unwound from a pay-off reel, passed through a looper, and sent to a pretreatment apparatus. Next, the surface of the steel strip is plated as it passes between electrodes immersed in electroplating solution. The steel strip is then washed and dried, passed through a looper and a shearing machine, then wound onto a tension reel.

U.S. Pat. No. 7,407,051 B1 to Farris et al. discloses a stainless steel sprocket support shaft for a nozzleless conveyor belt and sprocket cleaning apparatus. The stainless steel sprocket may be surface finished by electropolishing. U.S. Pat. No. 5,491,036 to Carey, II et al. generally discloses an electrolysis process for applying a tin coating of carbon steel.

SUMMARY OF THE INVENTION

The above described patents propose a variety of methods for electropolishing or electroplating various materials. However, there still exists a need for a system and method for electropolishing and electroplating metal conveyor belts that improves sanitation and product release characteristics, particularly with respect to conveyor belts used in food processing. There also exists a need for a system and method for electropolishing and electroplating metal conveyor belts that reduces wear and friction on the conveyor belts.

In view of the foregoing, one aspect of the present invention provides a continuous electropolishing and/or electroplating process for metal conveyor belts. This process provides benefits such as improved sanitation, improved product release characteristics, and reduced wear and friction, which are particularly important for conveyor belts used in food processing.

To create a continuous process, the belt is fed from an infeed roll, passed through an electrolytic fluid bath, and collected on a take-up roll after the electropolishing or electroplating process. Guide rolls keep the belt in tension, direct the belt into the bath and position the belt between two metal plates parallel to a surface of the belt that are immersed in the electrolytic fluid, while also maintaining conductivity through the belt. As the belt leaves the electrolytic bath, it passes by an air knife that removes excess electrolyte, before being rinsed to neutralize the electrolyte. The electrolytic fluid that is used in the process is cooled and filtered continuously to maintain a temperature greater than or equal to 120° F. and less than or equal to 150° F. The filter size is preferably less than 3 microns, but can be other sizes as well.

The belt may be guided past one or multiple sets of metal plates. In one embodiment, by directing the belt 180° around a roller, the belt may pass on opposite sides of the same plate, such that both sides of the plate may be used in the electropolishing or electroplating process. The plates may be fixed in the electrolytic bath, or some plates may be movable to facilitate the loading of the belt into the belt path.

Belts are separated into smaller sections, typically 50 to 100 feet long, for ease of handling and shipping. These sections may be connected sequentially, such that the leading end of a new roll of belt is connected to the trailing end of the previous roll of belt, to maintain a continuous process. These sections can be disconnected and placed on separate take-up rolls after processing. Leader chains may also be used to guide the ends of the belt into and out of the bath while maintaining tension. Materials used in the process, such as the plate material and electrolyte material, may be of any suitable type such as are currently used or may be developed for electropolishing and electroplating.

According to one embodiment, an electropolishing or electroplating system is provided that comprises an inner tank configured to hold electrolytic fluid, the inner tank comprising a conductive plate, an outer tank surrounding the inner tank, a tension device configured to maintain tension in a continuous assembly of interconnected components between a first roller and a second roller, and a system drive configured to move the continuous assembly of interconnected components from the first roller through the inner tank and onto the second roller.

A method for electropolishing or electroplating a continuous assembly of interconnected components is also described. According to one embodiment, the method comprises unrolling a continuous assembly of interconnected components from a first roller, guiding the continuous assembly of interconnected components into an electrolytic bath comprising at least one conductive plate, applying current to at least one of the continuous assembly of interconnected components and the at least one conductive plate, moving the continuous assembly of interconnected components out of the electrolytic bath, and rolling the continuous assembly of interconnected components onto a second roller. Tension is maintained in the continuous assembly of interconnected components between the first roller and the second roller.

Still other aspects, features and advantages of the present invention are readily apparent from the following detailed description, simply by illustrating a number of exemplary embodiments and implementations, including the best mode contemplated for carrying out the present invention. The present invention also is capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

A system and method for electropolishing or electroplating a continuous assembly of interconnected components is described. In the following description, for purposes of explanation, numerous specific details are set forth in order to provide a thorough understanding of the exemplary embodiments. It is apparent to one skilled in the art, however, that the present invention can be practiced without these specific details or with an equivalent arrangement.

Figure 1:
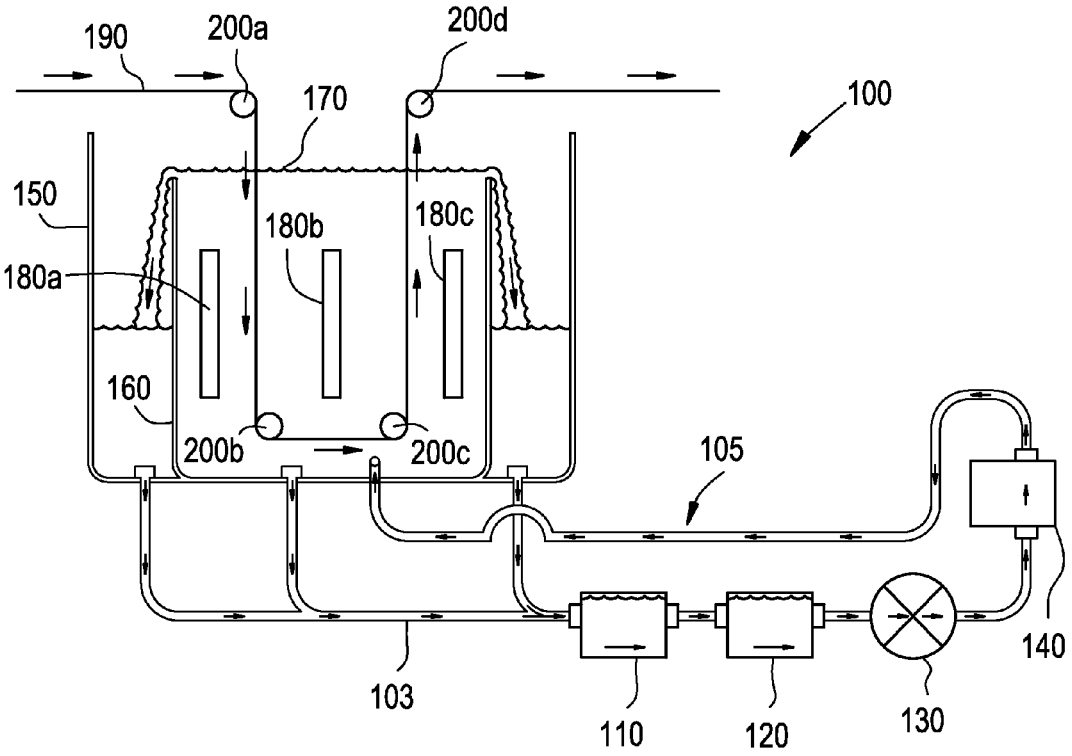
FIG. 1 is a cutaway view of a system for electropolishing or electroplating a continuous assembly of interconnected components in accordance with an embodiment.

Referring now to the drawings, wherein like reference numerals designate identical or corresponding parts throughout the several views, FIG. 1 is a cutaway view of a continuous system 100 for electropolishing or electroplating metal conveyor belts in accordance with one embodiment of the invention. The system 100 has an inner tank 160 surrounded by a larger, outer tank 150. Inner tank 160 is adapted to receive one or more conductive plates 180*a-c*, and comprises one or more guide rollers 200*b*, 200*c*. Conductive plates 180*a-c* can be made of any conductive material. In one embodiment, conductive plates 180*a-c* are made of copper.

Both inner tank 160 and outer tank 150 are adapted to hold electrolytic fluid 170. Electrolytic fluid 170 is allowed to overflow from inner tank 160 into outer tank 150. Electrolytic fluid 170 may flow into inner tank 160 and/or outer tank 150 via one or more input pipes 105, and out of inner tank 160 and/or outer tank 150 via one or more output pipes 103. Electrolytic fluid 170 exiting inner tank 160 and/or outer tank 150 is filtered by screen filter 110 and bag filter 120 achieve filtration of electrolytic fluid 170. Screen filter 110 and/or bag filter 120 can have a size of 3 microns or less. Although shown and described with respect to both an inner tank and an outer tank, it is contemplated that the electrolytic fluid 170 can be recirculated by means of input and output pipes in inner tank 160 only, and outer tank 150 can be omitted.

Electrolytic fluid 170 is then passed through pump 130 to chiller 140, where it is cooled before being returned to inner tank 160 and/or outer tank 150 via input pipe 105. In one embodiment, electrolytic fluid 170 is cooled to a temperature between 120° F. and 150° F. by chiller 140. Thus, according to system 100, electrolytic fluid 170 can be filtered and cooled continuously. The illustrated arrows within output pipes 103 and input pipes 105 show the exemplary travel of electrolytic fluid 170 therein.

Although shown and described as screen filter 110, bag filter 120, pump 130 and chiller 140 being consecutively positioned, any suitable configuration may be employed. For example, screen filter 110 and bag filter 120 can be entirely separate from chiller 140, the order of the components can be changed, the path of electrolytic fluid 170 can be varied, and more or less output pipes 103 and/or input pipes 105 can be employed. In another embodiment, one or more of screen filter 110, bag filter 120, pump 130 and chiller 140 may be positioned within inner tank 160 and/or outer tank 150.

To create a continuous electropolishing or electroplating process, a continuous assembly of interconnected components (in this embodiment, a conveyor belt 190) is guided through the illustrated system according to the arrows alongside conveyor belt 190, which indicate one exemplary direction of travel of the conveyor belt 190. Conveyor belt 190 is metal, and may be stainless steel. Guide roller 200*a* directs the conveyor belt 190 into the electrolytic fluid 170, and positions the conveyor belt 190 between plates 180*a* and 180*b* immersed in the electrolytic fluid 170. In one embodiment, conveyor belt 190 passes horizontally above outer tank 150 and inner tank 160, and turns vertically downward via guide roller 200*a* into inner tank 160 comprising electrolytic fluid 170. Below plates 180*a*, 180*b*, conveyor belt 190 passes around guide roller 200*b* and is directed toward guide roller 200*c*. Conveyor belt 190 then passes upward toward guide roller 200*d*. In one embodiment, guide roller 200*d* is adapted to allow conveyor belt 190 to travel horizontally away from outer tank 150 and inner tank 160. In this embodiment, guide rollers 200*b* and 200*c* are submerged in electrolytic fluid 170, while guide rollers 200*a* and 200*d* are outside of electrolytic fluid 170. However, any other suitable configuration of guide rollers 200*a-d* may be employed.

As shown in FIG. 1, plates 180*a-c* are submerged in electrolytic fluid 170 comprised in inner tank 160. In this embodiment, conveyor belt 190 passes vertically between plate 180*a* and 180*b*; along the edge of plate 180*b*; then vertically between plates 180*b* and 180*c*. Thus, all sides and angles of conveyor belt 190 are exposed to plates 180*a-c*. Also, although conveyor belt 190 is shown entering and exiting inner tank 160 from above, other configurations, including a horizontal configuration, may be used in accordance with other embodiment of the invention.

In the illustrated embodiment, metal plates 180*a-c* each have a surface parallel to a surface of conveyor belt 190. These surfaces of plates 180*a-c* can be vertical, as shown in FIG. 1. In another embodiment, the surfaces of plates 180*a-c* can be angled from horizontal such that gas pockets cannot form on the surface and interfere with current transfer between the plates 180*a-c* and conveyor belt 190.

Although three plates are shown in FIG. 1, it is understood than any suitable number and combination of plates may be used, as well as any suitable path for conveyor belt 190. In one embodiment, by directing conveyor belt 190 180° around one or more guide rollers, conveyor belt 190 may pass on opposite sides of the same plate 180, such that both sides of the plate 180 may be used in the electropolishing or electroplating process. In this manner, belt 190 may be guided in a serpentine path around multiple plates 180.

Conveyor belt 190 may be a single, continuous belt or may comprise a plurality of component parts (e.g., links and rods) that are connected together to form the belt. When conveyor belt 190 is traveling in a generally straight line, the component parts may be aligned in the same direction, and interconnecting parts of each component part may be covered by interconnecting parts of another component part in a default or straight-line position or orientation. As conveyor belt 190 passes over rollers 200*a-d* and passes through turns, such as in the serpentine path shown in FIG. 1, the component parts may be allowed to turn with respect to one another into multiple positions, thereby more directly exposing previously covered portions of the component parts to electrolytic fluid 170 and plates 180*a-c*. As such, in the embodiment shown in FIG. 1, by passing the belt 190 through the serpentine path shown, the system 100 facilitates exposure of certain portions of component parts that are not otherwise exposed or exposed well if a simple linear path were to be used during the electropolishing or electroplating process.

In the embodiment shown in FIG. 1, it is noted that conveyor belt 190 and its component parts have an upper and lower side, and that guide rollers 200*b* and 200*c* in inner tank 160 facilitate improved exposure of the lower side of the interconnecting parts of each component part. Although not shown in FIG. 1, configurations may be employed whereby guide rollers 200*a* and 200*d* are provided in electrolytic fluid 170 so as to facilitate improved exposure of the upper side of the interconnecting parts of each component part. In still other embodiments, other configurations may be adapted to facilitate exposure of interconnecting parts of each component part to electrolytic fluid 170 and plates 180*a-c*.

Current may be applied to conveyor belt 190 with a conductive brush or roll contact, or other suitable dynamic electrical connection. In an electropolishing application, the current passes from conveyor belt 190, through electrolytic fluid 170, and to plates 180*a-c*. In an electroplating application, the current passes from plates 180*a-c*, through electrolytic fluid 170, and to conveyor belt 190. In the embodiment illustrated in FIG. 1, plates 180*a-c* are fixed within inner tank 160.

Figure 2:
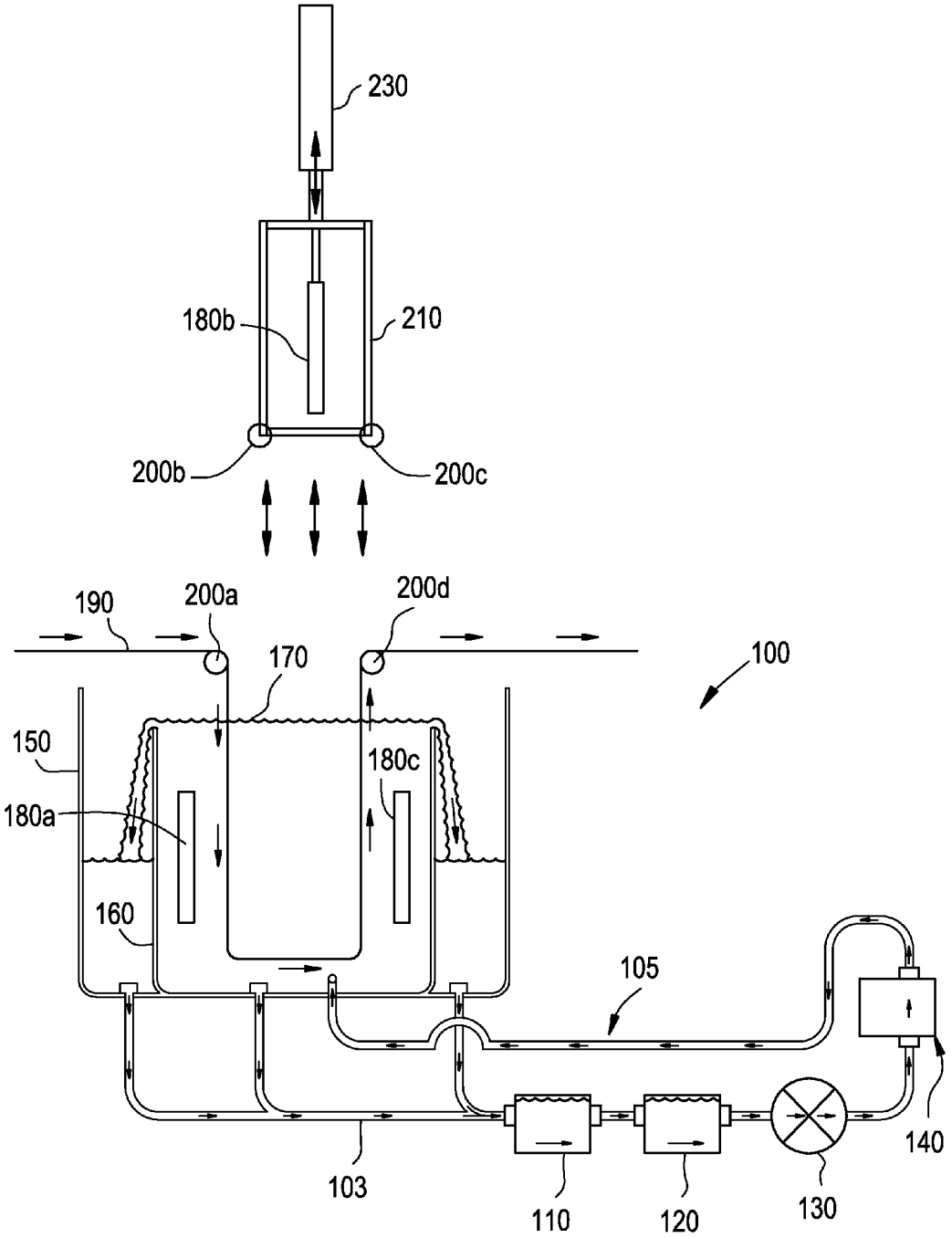
FIG. 2 is a cutaway view of a system for electropolishing or electroplating a continuous assembly of interconnected components in accordance with another embodiment.

Turning now to FIG. 2, FIG. 2 illustrates another cutaway view of a continuous system 100 for electropolishing or electroplating metal conveyor belts in accordance with an embodiment of the invention. In this embodiment, plate 180*b* is movable to facilitate loading of conveyor belt 190 into inner tank 160. However, it is contemplated that any combination of plates 180*a-c* can be similarly movable.

As shown in FIG. 2, plate 180*b* is removed from inner tank 160 to ease loading of conveyor belt 190 into inner tank 160. When retracted, plate 180*b* is housed in roller frame 210. Roller frame 210 comprises guide rollers 200*b* and 200*c*, and has an open configuration such that electrolytic fluid 170 can flow freely therethrough when positioned within inner tank 160. Once conveyor belt 190 is positioned within inner tank 160, roller frame 210 and plate 180*b* can be inserted into inner tank 160 by means of hydraulic cylinder 230, which is also operable to retract roller frame 210 and plate 180*b* from inner tank 160. Although described with respect to a hydraulic cylinder, it is contemplated that any vertical displacement device may be used to vertically position roller frame 210 and plate 180*b*.

Thus, according to this embodiment, conveyor belt 190 can be placed over guide roller 200*a*, into inner tank 160 between plates 180*a* and 180*c*, and over guide roller 200*d* when loading conveyor belt 190. Roller frame 210 (having guide rollers 200*b* and 200*c*) and plate 180*b* can then be placed into inner tank 160, and the placement of guide rollers 200*a-d* and plates 180*a-c* shown in FIG. 1 can be achieved with a movable plate 180*b*. In another embodiment, hydraulic cylinder 230 can vertically displace plate 180*b*, while roller frame 210 remains stationary.

Figure 3A:
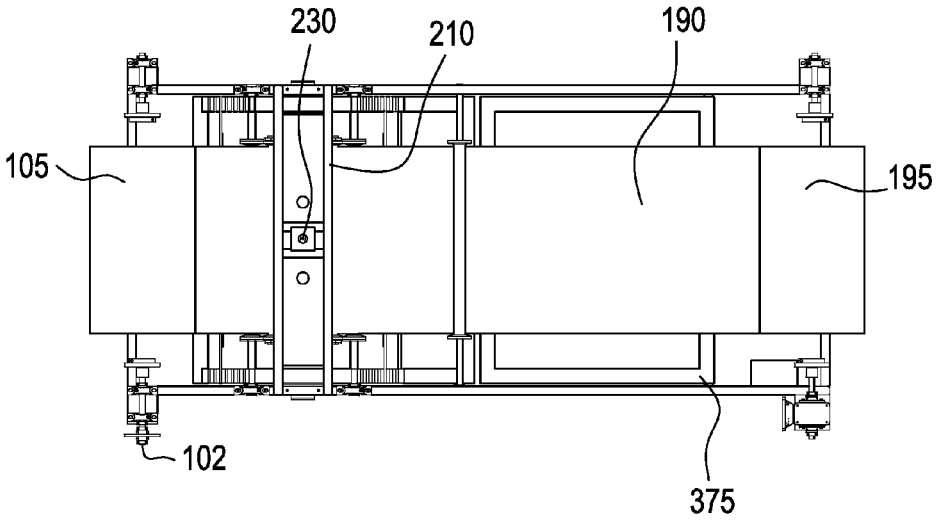
FIG. 3A is a top view of a system for electropolishing or electroplating a continuous assembly of interconnected components in accordance with an embodiment.
Figure 3B:
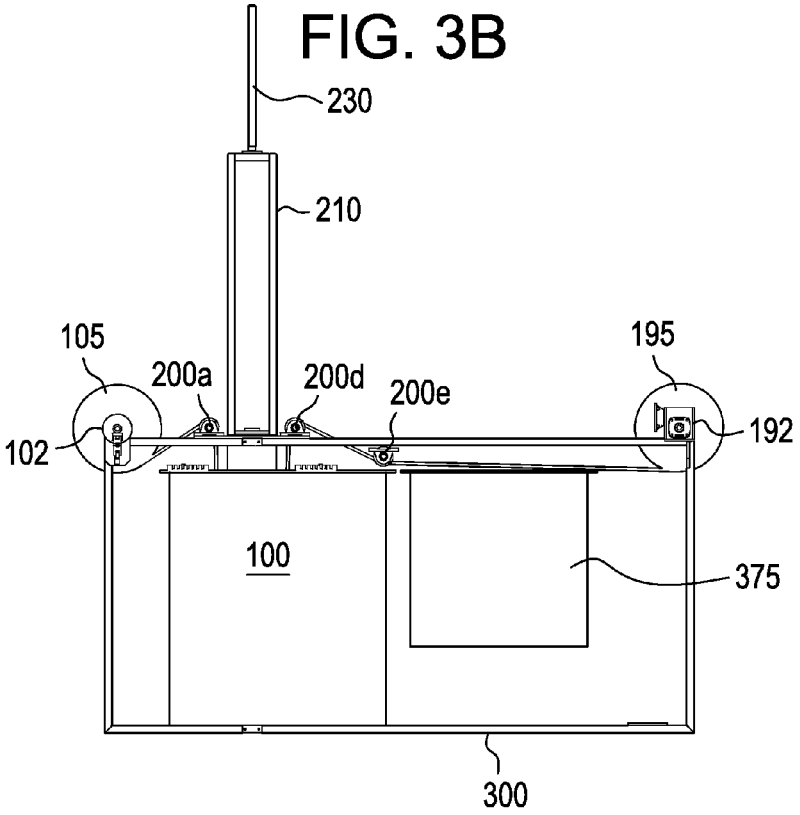
FIG. 3B is a side view of a system for electropolishing or electroplating a continuous assembly of interconnected components in accordance with an embodiment.
Figure 3C:
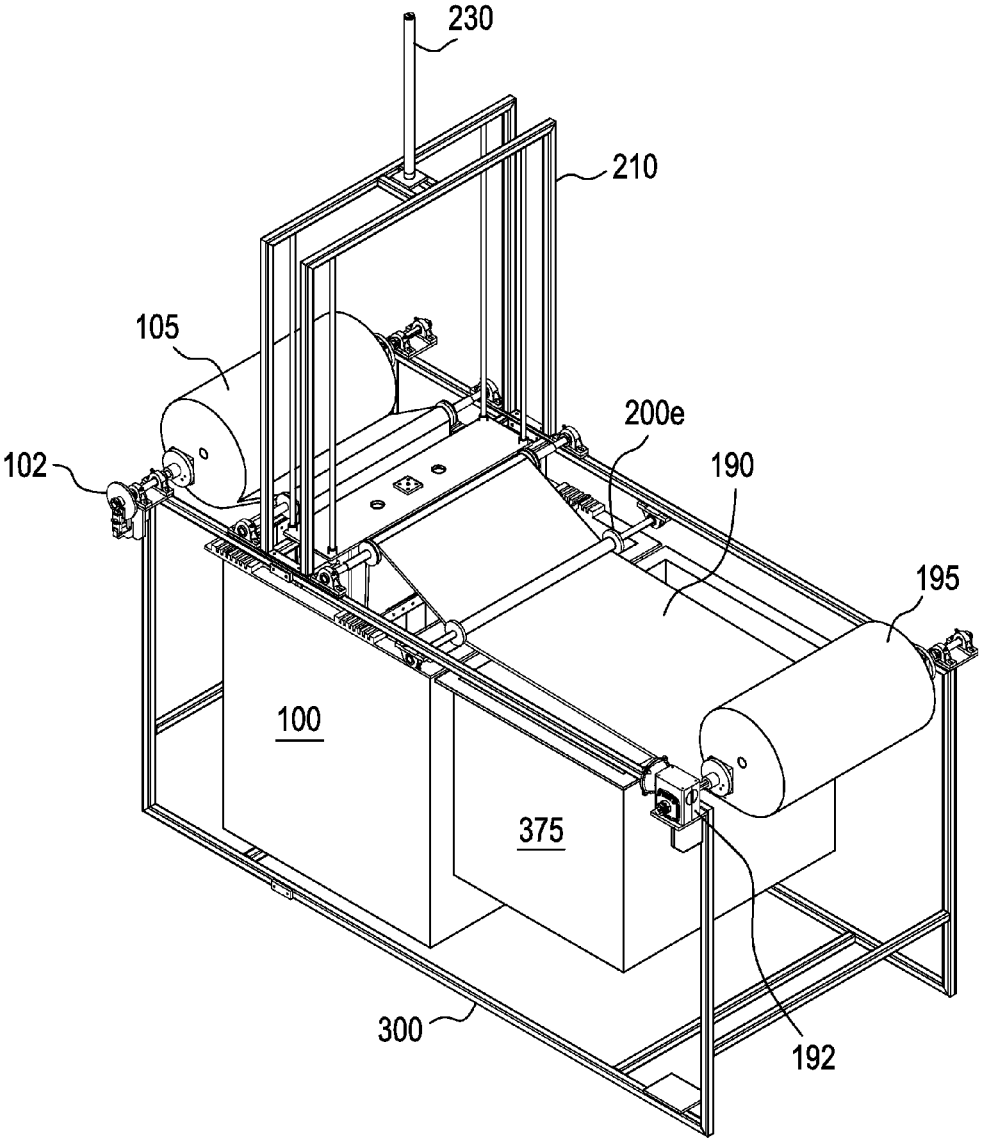
FIG. 3C is a perspective view of a system for electropolishing or electroplating a continuous assembly of interconnected components in accordance with an embodiment.

FIGS. 3A, 3B and 3C show a top view, side view and perspective view, respectively, of a system for electropolishing or electroplating a metal conveyor belt according to an embodiment of the invention. In this embodiment, plate 180*b* is movable to facilitate loading of conveyor belt 190 into inner tank 160. Thus, system housing 300 includes hydraulic cylinder 230 and roller frame 210. As shown in FIGS. 3A-3C, conveyor belt 190 is unrolled from an in-feed roll 105 onto guide roller 200*a* and through the remainder of system 100, and exiting via guide roller 200*d*. Conveyor belt 190 is guided by guide roller 200*e* over tank 375, where excess electrolytic fluid is dripped from conveyor belt 190.

Conveyor belt 190 is moved along its path by system drive 192. System drive 192 may be, for example, a motor. System drive 192 is used to create torque or tension to pull conveyor belt 190 from in-feed roll 105, through the system and onto take-up roll 195. A tension device 102 is used in conjunction with in-feed roll 105 to create a resistive torque or tension in conveyor belt 190 as it is fed from in-feed roll 105. Tension device 102 may be, for example, a brake, a clutch, a motor, and combinations thereof, both mechanical and electrical. Thus, conveyor belt 190 can remain under tension throughout the electropolishing or electroplating process from the in-feed roll 105 to the take-up roll 195. However, it is contemplated that the goals of the described embodiments can be accomplished by providing tension in conveyor belt 190 at least while it is immersed in electrolytic fluid 170.

The tension maintained in conveyor belt 190 ensures good physical and electrical contact between component parts of conveyor belt 190 (e.g., links and rods), and allows the current to pass through the immersed portion of conveyor belt 190 evenly. Such tension creates larger points of contact between the current generation device and conveyor belt 190 (as well as between the component parts of conveyor belt 190, such as links and rods), resulting in less electrical resistance. This increased conductivity ensures more uniform current flow throughout conveyor belt 190, resulting in a more uniform polishing or plating effect.

To further increase contact area between links and rods, thus increasing conductivity, conveyor belt 190 can comprise coined links, such as those shown and described in U.S. Pat. No. 4,932,925, which is herein incorporated by reference in its entirety. Such coined links can have a work-hardened area having a radius equal to the radius of the rod, such that the rod has a relatively large area of contact with the link when the belt is kept in tension. With the belt in tension, the rod is maintained in coined area of the link with constant contact maintained between the rod and the link.

Embodiments of the invention can be used to electropolish or electroplate conveyor belts that are separated into smaller sections, for example 50' to 100' long, for ease of handling and shipping. In accordance with the described embodiments, these sections may be connected sequentially, such that the leading end of a new roll of belt is connected to the trailing end of the previous roll of belt, to maintain a continuous process. These sections can be disconnected and placed on separate take-up rolls after processing. Leader chains may also be used to guide the ends of the belt into and out of the electrolytic fluid 170 while maintaining tension.

Figure 4A:
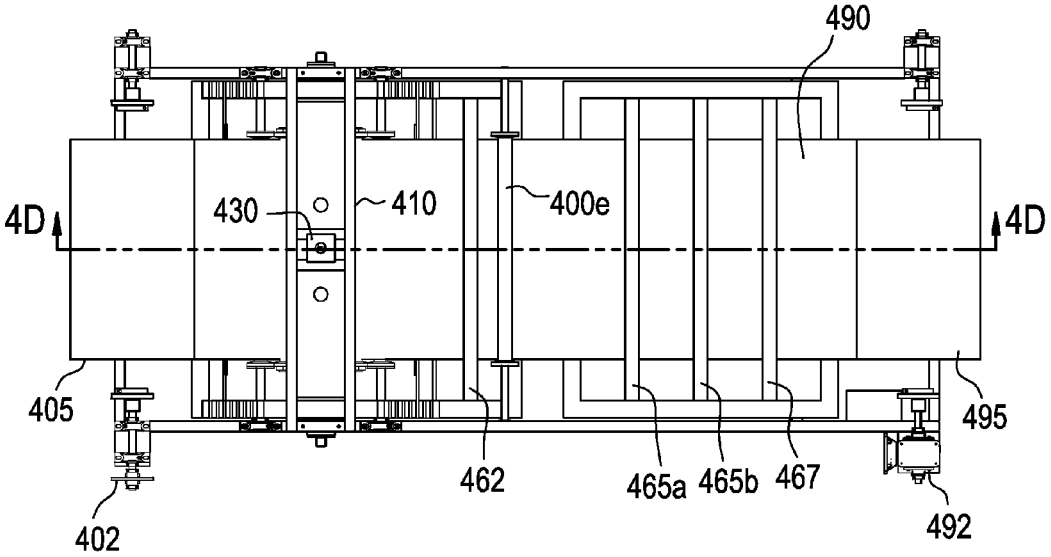
FIG. 4A is a top view of a system for electropolishing or electroplating a continuous assembly of interconnected components in accordance with an embodiment.
Figure 4B:
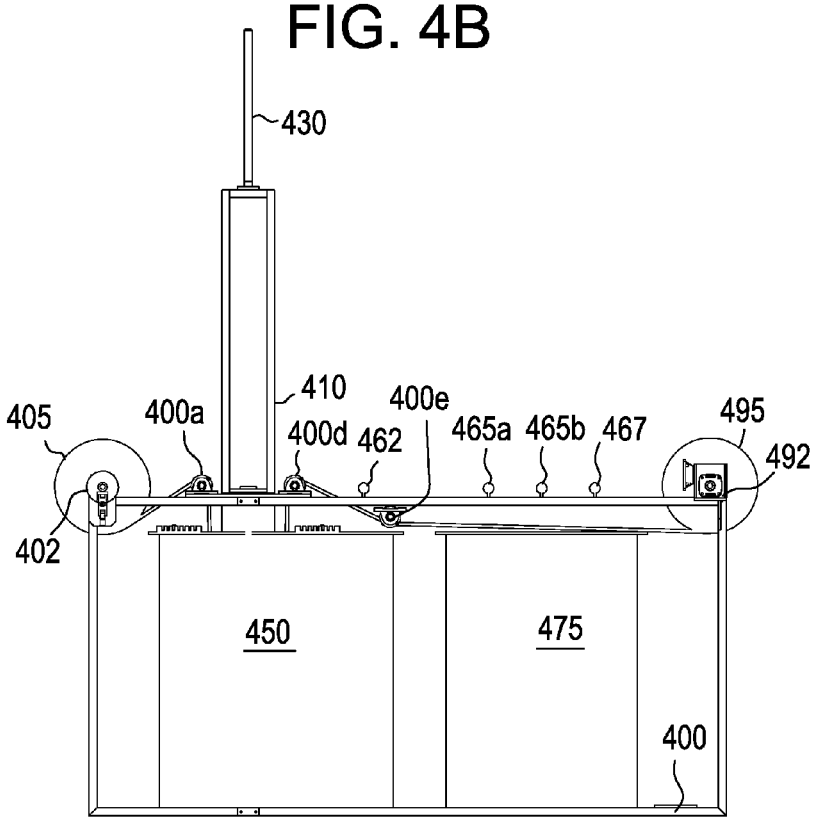
FIG. 4B is a side view of a system for electropolishing or electroplating a continuous assembly of interconnected components in accordance with an embodiment.
Figure 4C:
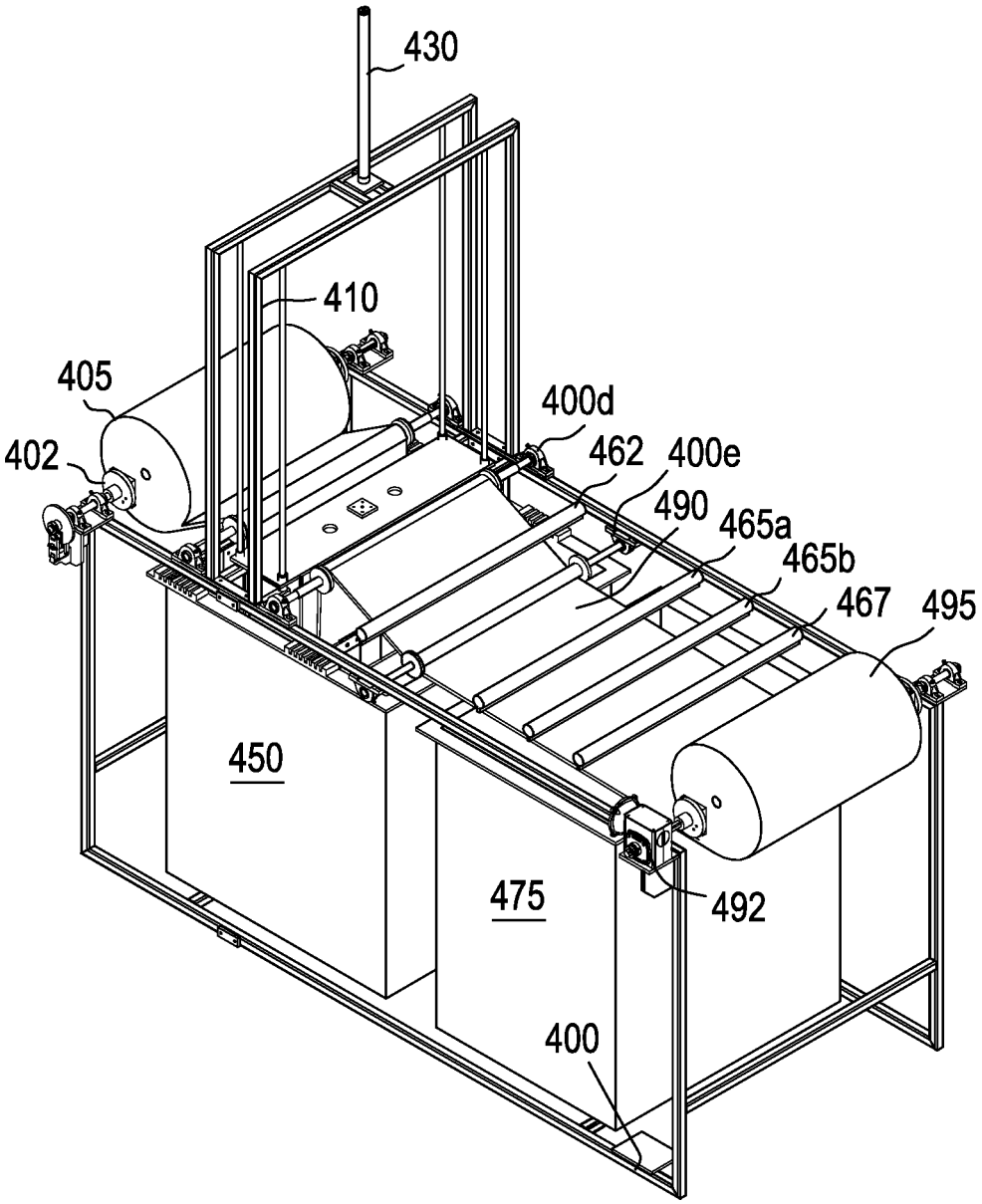
FIG. 4C is a perspective view of a system for electropolishing or electroplating a continuous assembly of interconnected components in accordance with an embodiment.
Figure 4D:
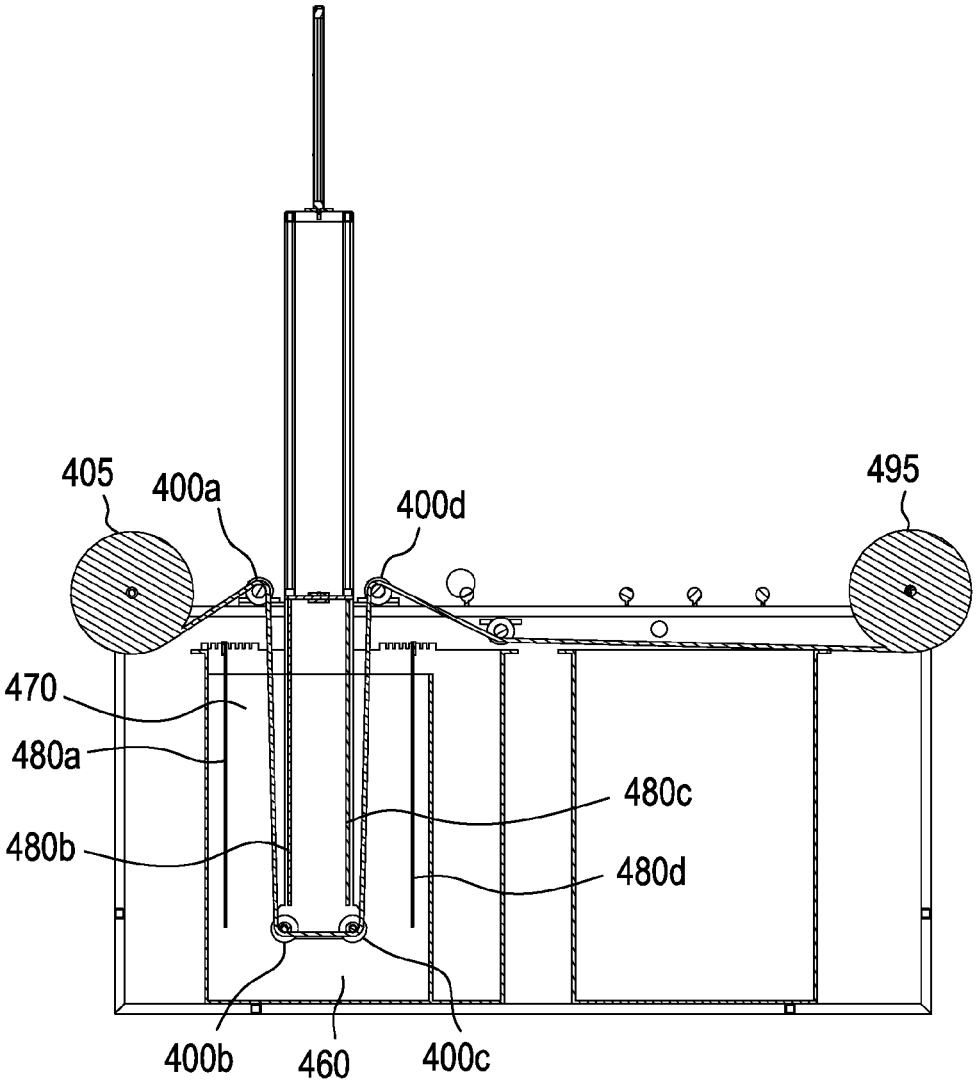
FIG. 4D is a cutaway side view of a system for electropolishing or electroplating a continuous assembly of interconnected components in accordance with an embodiment.
Figure 4E:
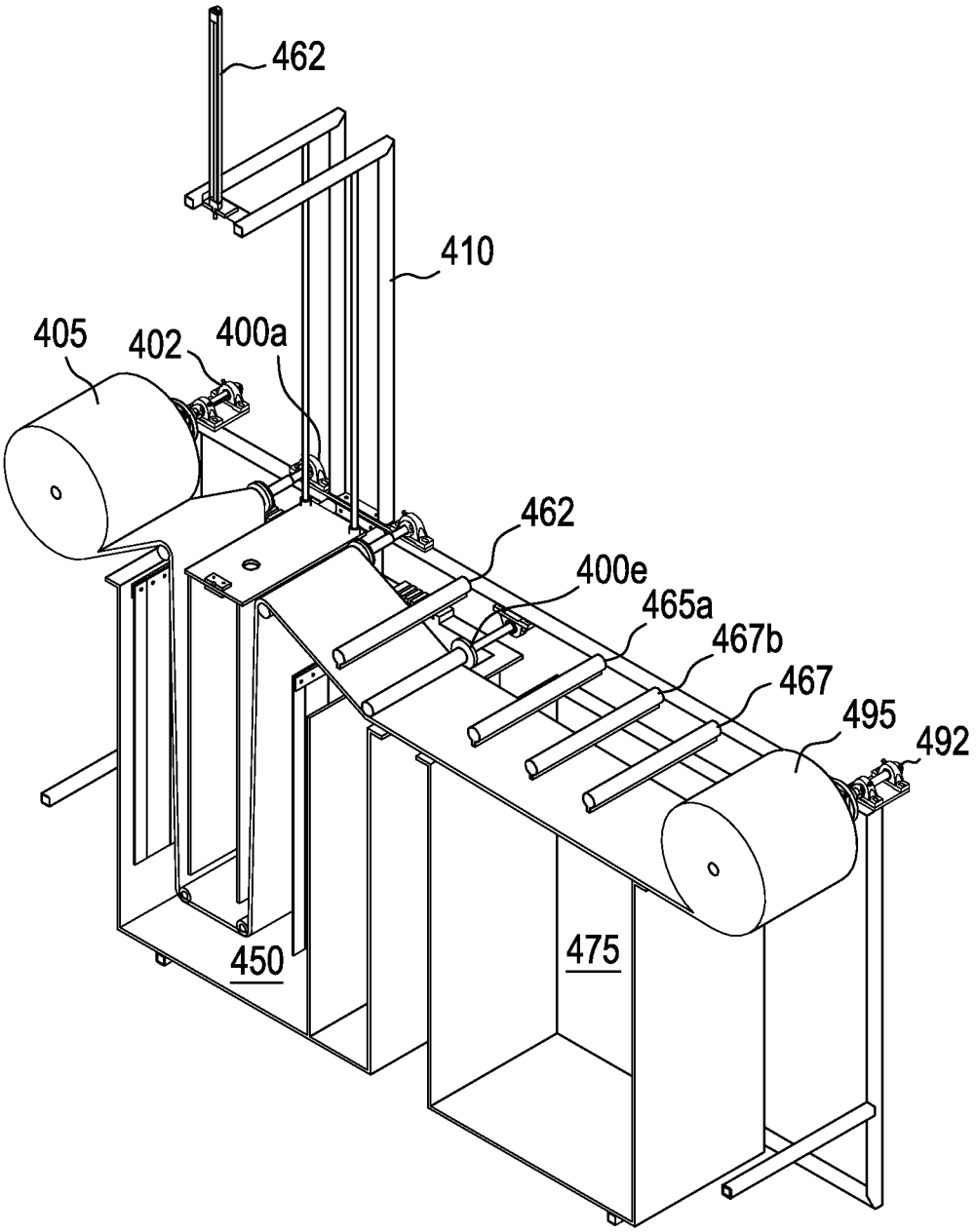
FIG. 4E is a cutaway perspective view of a system for electropolishing or electroplating a continuous assembly of interconnected components in accordance with an embodiment.

FIGS. 4A, 4B and 4C show a top view, side view and perspective view, respectively, of a system for electropolishing or electroplating a metal conveyor belt according to another embodiment of the invention. FIGS. 4D and 4E show a front cutaway view and perspective cutaway view of the system illustrates in FIGS. 4A-4C, which has been cut away at line 4D as shown in FIG. 4A. In this embodiment, conductive plates 480*b* and 480*c* are movable to facilitate loading of conveyor belt 490 into inner tank 460. Conductive plates 480*b* and 480*c* are movable on roller frame 410 by displacement device 430. Displacement device 430 may be a hydraulic cylinder, for example.

As shown in FIGS. 4A-4E, conveyor belt 490 is unrolled from an in-feed roll 405 onto guide roller 400*a*. Conveyor belt 490 continues into outer tank 450 and inner tank 460, which comprises an electrolytic bath 470. Current is applied to conveyor belt 490. Conveyor belt 490 passes between conductive plates 480*a* and 480*b* in electrolytic bath 470, and is guided along guide rollers 400*b* and 400*c* along the bottom of conductive plates 480*b* and 480*c*. Conveyor belt 490 then passes out of electrolytic bath 470 between conductive plates 480*c* and 480*d*.

Electroplating or electropolishing is achieved while conveyor belt 490 is immersed in electrolytic bath 470. With respect to electroplating, a current is applied to conductive plates 480*a-d*, oxidizing the metal atoms that comprise the conductive plates and allowing them to dissolve into electrolytic bath 470. The dissolved metal ions in electrolytic bath 470 are moved by the electric field to coat conveyor belt 490. Thus, a layer of metallic material is deposited on the surface of conveyor belt 490.

With respect to electropolishing, a current is applied to conveyor belt 490, oxidizing the metal atoms on the surface of conveyor belt 490 and allowing them to dissolve into electrolytic bath 470. The dissolved metal ions in electrolytic bath 470 are moved by the electric field to conductive plates 480*a-d*. Thus, a smoother, polished surface results on conveyor belt 490.

Once conveyor belt 490 has been electropolished or electroplated, it is moved along guide roller 400*d* past a first dryer 462 positioned above outer tank 450. First dryer 462 removes excess electrolyte from conveyor belt 490 and directs it download into outer tank 450 and/or inner tank 460. Conveyor belt 490 is guided along guide roller 400*e* under rinse nozzles 465*a* and 465*b*, which pours a rinsing fluid (such as water, for example) onto conveyor belt 490. Rinse nozzles 465*a* and 465*b* are positioned over rinse tank 475, which collects the excess water dripping from conveyor belt 490. Although shown and described with respect to two rinse nozzles 465*a* and 465*b*, it is contemplated that one or both rinse nozzles can be omitted. Further, one or both of rinse nozzles 465*a* and 465*b* can be pressurized to decrease rinse time and increase rinse efficiency.

Conveyor belt 490 moves under a second dryer 467 that removes excess rinsing fluid from conveyor belt 490. Second dryer 467 is positioned above rinse tank 475 such that rinse tank 475 continues to collect excess water dripping from conveyor belt 490 while it is being dried by second dryer 467. First dryer 462 and second dryer 467 may be air knifes, for example, to accelerate drying. Although shown and described with both first dryer 462 and second dryer 467, it is contemplated that one or both dryers can be omitted. Conveyor belt 490 is then rolled onto take-up roll 495.

Conveyor belt 490 is moved along the above-described path by a system drive 492. System drive 492 can be a motor, for example, and is connected to take-up roll 495. Tension is maintained in conveyor belt 490 at least between guide roller 400*a* and guide roller 400*d* (in other words, while conveyor belt 490 is submerged in electrolytic bath 470). This tension can be accomplished by creating a resistive torque or tension at tension device 402, which is connected to in-feed roll 405. Tension device 402 may include, for example, a brake, a clutch, a motor, and combinations thereof, both mechanical and electrical.

Although described herein with respect to conveyor belts, it is contemplated that the methods and systems described herein can be applied to any rollable and/or conductive materials, including chains or other continuous assemblies of interconnected components. Such electropolishing or electroplating applied in accordance with the described embodiments results in improved sanitation, reduced wear and friction on the treated parts, and improved product release characteristics, particularly with respect to food processing applications.

The present invention has been described in relation to particular examples, which are intended in all respects to be illustrative rather than restrictive. Those skilled in the art will appreciate that many different combinations of materials and components will be suitable for practicing the present invention.

Other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

What is claimed is:

1. A method for electrochemically processing a conveyor belt including a continuous assembly of interconnected components, the method comprising:

rolling the conveyor belt from a first roller into an electrolytic bath comprising at least one conductive plate;

applying current to at least one of the conveyor belt and the at least one conductive plate while at least part of the conveyor belt is within the electrolytic bath;

guiding the conveyor belt out of the electrolytic bath and onto a second roller; and actively maintaining the conveyor belt under tension between the first roller and the second roller to maintain physical contact between the interconnected components.

2. The method of claim 1, wherein the conveyor belt is unrolled from the first roller and rolled onto the second roller by a system drive connected to the second roller.

3. The method of claim 1, wherein the interconnected components include links and rods, and the conveyor belt is actively maintained under tension to maintain the rods in coined areas of the links.

4. The method of claim 1, wherein tension is actively maintained in the conveyor belt between the first roller and the second roller by a tension device connected to the first roller that is configured to resist unrolling of the conveyor belt from the first roller.

5. The method of claim 4, wherein the tension device comprises at least one of a brake, a clutch, and a motor.

6. The method of claim 1, wherein the at least one conductive plate is movable.

7. The method of claim 6, wherein the at least one conductive plate is movable by a displacement device.

8. The method of claim 7, wherein the displacement device is a hydraulic cylinder.

9. The method of claim 1, further comprising:

filtering at least a portion of the electrolytic bath.

10. The method of claim 1, further comprising:

cooling at least a portion of the electrolytic bath.

11. The method of claim 1, further comprising:

rinsing the conveyor belt.

12. The method of claim 1, further comprising:

drying the conveyor belt.

13. The method of claim 12, wherein the conveyor belt is dried with an air knife.

* * * * *